US006569065B1

(12) United States Patent
Menold et al.

(10) Patent No.: US 6,569,065 B1
(45) Date of Patent: May 27, 2003

(54) EXERCISE APPARATUS

(76) Inventors: Elmar Menold, Schwabhauserstr. 22, D-97944 Boxberg (DE); Jürgen Steinacker, Johann-Stockar-Weg 22, D-89075 Ulm (DE)

( * ) Notice: Subject to any disclaimer, the term of this patent is extended or adjusted under 35 U.S.C. 154(b) by 0 days.

(21) Appl. No.: 09/831,336

(22) PCT Filed: Nov. 9, 1999

(86) PCT No.: PCT/DE99/03571

§ 371 (c)(1),
(2), (4) Date: May 8, 2001

(87) PCT Pub. No.: WO00/27486

PCT Pub. Date: May 18, 2000

(30) Foreign Application Priority Data

Nov. 9, 1998 (DE) ..... 198 51 511

(51) Int. Cl.[7] ..... A63B 69/06
(52) U.S. Cl. ..... 482/72; 482/56; 482/127
(58) Field of Search ..... 482/96, 72, 56, 482/51, 142, 71–73, 121, 129, 99, 127

(56) References Cited

U.S. PATENT DOCUMENTS

| | | | | |
|---|---|---|---|---|
| 4,625,962 A | | 12/1986 | Street | |
| 4,728,102 A | | 3/1988 | Pauls | |
| 4,772,013 A | | 9/1988 | Tarlow, Jr. | |
| 4,940,227 A | | 7/1990 | Coffey | |
| 5,354,251 A | * | 10/1994 | Sleanmaker | 482/96 |
| 5,624,357 A | | 4/1997 | Englehart et al. | |
| 5,738,616 A | | 4/1998 | Robertson | |
| 5,820,528 A | * | 10/1998 | McAndrew | 482/72 |

FOREIGN PATENT DOCUMENTS

| | | |
|---|---|---|
| DE | 601058 | 8/1934 |
| DE | 78 16 531 | 9/1978 |
| DE | 90 07 392 | 7/1991 |
| DE | 93 11 568.7 | 12/1993 |
| DE | 44 18 795 | 5/1996 |
| DE | 296 20 700 | 11/1996 |
| DE | 296 20 700 | 5/1997 |
| WO | WO 92/00780 | 1/1992 |

* cited by examiner

*Primary Examiner*—Jerome W. Donnelly
(74) *Attorney, Agent, or Firm*—Collard & Roe, P.C.

(57) ABSTRACT

The invention relates to different embodiments of an exercises apparatus in which the pulling motion exerted on a cable system is transmitted to a brake device so as to generate a load on the user. The invention relates in particular to examples of how the apparatus can be used to simulate different kinds of movements. To this end the apparatus has a modular structure and/or advantageous mechanical additional elements of the apparatus permit a multiple use thereof.

17 Claims, 8 Drawing Sheets

EXERCISE APPARATUS

CROSS REFERENCE TO RELATED APPLICATIONS

Applicants claim priority under 35 U.S.C. §119 of German Application No. 198 51 511.1, filed: Nov. 9, 1998. Applicants also claim priority under 35 U.S.C. §120 of PCT/DE99/03571, filed: Nov. 9, 1999. The international application under PCT article 21(2) was not published in English.

The invention relates to an exercise apparatus, in particular to an exercise apparatus for simulating movements of the body, in particular different types of arm-swinging movements.

An exercise apparatus is known, for example from U.S. Pat. No. 4,728,102 that simulates the movements of a long-distance skier and the stress to which the body is subjected in this connection. The movements of the arms in opposite directions are transmitted via the rotation of an adjustable brake disk.

DE 90 07 392 U1 describes a paddle ergometer with two levers swiveling about vertical axles. Said levers can be deflected against a braking force and are reset automatically by pulling a cord that connects a paddle shaft with a lever.

DE 296 20 700 describes an exercising device for simulating the paddling activity of a canoeist, whereby a cable system serves for transmitting the force and for driving a braking device in this case as well. A freely movable, hand-held paddle imitation has a bar with two spaced-apart fastening points for a cable extending through via a cable-guiding system. A cable-tensioning device compensates asymmetries in the movements of the arms in opposite directions, and keeps both ends of the cable tensioned while the device is being actuated. Each pulling motion of one end of the paddle imitation is transmitted via a drive arrangement comprising rollers that are looped by cable rope a number of times, as well as freewheel devices, leading to a wind wheel acting as the brake device.

The present invention is based on the problem of further developing exercise apparatuses of said type in an advantageous manner.

Solutions of said problem according to the invention are specified in the independent claims. The dependent claims contain advantageous embodiments and further developments of the invention.

According to a first advantageous variation of the exercise apparatus, the driving arrangement contains two laterally spaced roller elements that are driven by the cable system. For good transmission of the pulling force of the cable to the roller elements, the latter are advantageously looped by the cable a number of times. The roller elements are aligned coaxially with each other and may be arranged on a common rotatable shaft. When arranged on a common shaft, both roller elements are coupled with the shaft via freewheel elements rotating in the same sense. In another embodiment, provision is made for separate, axially aligned shaft sections for the drive system, such shaft sections in turn being coupled with freewheel elements via rollers or directly to the movement of the cable. The brake device is advantageously arranged between the spaced roller elements.

The brake device is advantageously rotatable in the form of disks or wheels and designed in the form of a wind wheel in a preferred embodiment. The axis of rotation of the brake device advantageously coincides with the axis of rotation of the roller elements and the shaft, or sections of the shaft. If the shaft is extending all the way through, the brake device can be connected with freewheel-coupled roller elements in a fixed manner, or connected with the shaft via another freewheel element. If the shaft is divided, provision is made for a freewheel-type clutch coupling for each of the two sections of the shaft. The preferred embodiment with a through-extending shaft results in a particularly simple and stable type of construction of the drive system and the brake device.

The ends of the cables of the cable system advantageously run from the actuating device directly onto roller elements without substantial prior reversing, preferably by way of cable feed-in guides that correct minor angular deviations in the alignment of the ends of the cables and safely guide an end of a cable that has been left behind and is running back.

For lateral adjustment of the cable feed-in positions or the feeding-in process, the roller elements in a first embodiment may be mounted on the shaft in a sliding manner as well. The displacement may advantageously take place jointly with the shift of the cable feed-in guides, particularly by arranging the rollers and the cable feed-in guides and preferably also the first reversing rollers of the cable guiding system downstream of the roller elements on a common carrier module. The roller elements may have a width also in the axial direction that covers the lateral variation of the cable feed-in position or the lateral adjustment range of the feed-in guide, and in that case do not need to be displaceable sideways. Finally, if the shaft is divided, the roller elements may be formed also by the jacket surface of the shaft itself, in which case the further explanations hereinafter then put the jacket surface of the shaft in the place of the roller elements.

The variation in the positions of the cable feed-in guides may be coupled to a simultaneous variation in the position of other components of the cable guiding system, especially of the position of narrow driver sleeves of the drive system and/or of first reversing rollers of the cable guiding system. The components capable of being variable in their positions in a coordinated manner are preferably combined in carrier modules within a module containing the mechanics, and can be displaced by the user as one uniform block, and preferably fixed by means of one single fixing element.

The cable guiding system preferably contains first reversing rollers that are slightly spaced from the drive system and reverse the run of the cable toward the center plane of the apparatus. A compact structure of the apparatus can be obtained in this way particularly also under the aspect of the fact that the guiding system for the cable is screened to a large extent by a covering for safety reasons. By reversing the run of the cable toward the center of the apparatus it is possible to limit the larger width of the module containing the mechanics required for the favorable initial run of the cable with parallel longitudinal axes to a short section in the longitudinal direction, so that it is possible to keep the type of construction used for the module containing the mechanics small. The angle of the run of the cable measured in the horizontal plane downstream of the first reversing rollers of the cable guiding system behind the drive system against the line of connection of the first reversing rollers preferably amounts to 45° at the most, in particular to 30° at the most. The run of the cable downstream of the first reversing rollers toward the center of the apparatus is preferably aligned approximately perpendicular in relation to the center plane with respect to the horizontal projection.

The first reversing rollers are preferably disposed in the lateral direction near the cable feed-in guides, so that the guidance of the cable via the drive system needs not to bridge any larger offset sideways.

In a preferred variation of the exercise apparatus, the roller elements are arranged in the center plane with a small spacing from one another. The spacing of the axes of rotation of the roller elements advantageously amounts to 20% at the most, preferably maximally to 10% of the spacing of the feed-in positions of the cable ends of the cable system coming from the actuation device and running into first, laterally spaced reversing elements, in particular reversing cable rollers of the cable guiding system. Arranging the roller elements rotated by the cable system near the center permits a particularly compact drive unit, which can then completely encapsulated in an advantageous manner in a housing with a small volume that preferably contains the brake device as well.

Advantageous is a coaxial arrangement of both roller elements on a common shaft and coupling of the roller elements with the common shaft by way of freewheel devices rotating in the same sense. The brake device is preferably arranged coaxially with the roller elements as well, in particular with a fixed connection of the common shaft with the rotating brake device. In another type of arrangement, the roller elements also can be rotatably arranged in such a way that they revolve about parallel, spaced-apart axes.

The separate or preferably common axes of rotation of the roller elements are preferably disposed upright, or in particular at least aligned approximately vertically. This permits further guidance of the cable system downstream of the roller elements to the rope tensioning device at least approximately parallel-with the center plane without requiring reversing elements, or only needing reversing elements that require particularly low expenditure. In conjunction with the coaxial arrangement of the roller elements and the brake device, a particularly compact drive system combined at the same time with a simple system for guiding the cable is obtained.

The actuation device can be connected with the motion module or handled detached from the latter depending on the type of movement involved. In connection with the variation that can be freely handled, it is again possible to make a distinction between whether the points of articulation of the cable system can be freely handled on the actuation device individually, or, as for example for imitating a swimming movement or an arm movement of a long distance skier, whether the points of articulation are fixed within the actuation device in a defined relative position to each other, such as, for example for imitating a canoe paddling movement, or also for imitating a rowing movement according to a special design. The cable pivot points may be guided in a displaceable manner as well. Furthermore, provision can be made that one end of the cable system is fixed and only the other end is displaceable by means of an actuation device, for example for imitating a unilateral stabbing-like paddling motion of the type used by kayak sportsmen.

The actuation device has handles that directly contain the pivot points, or are connected to the latter. Particularly advantageous on account of its simple structure and versatile applicability is an actuation device that can be freely handled in the way of a bar, a tube or the like, whereby the pivot points for the cable system are located on their ends.

The great number of possible embodiments of the cable system includes a system that comprises a through-extending, substantially non-expandable cable, which is secured with its ends on the pivot points of the actuation device and is guided with multiple reversals through the cable guiding system and is maintained taut within a range of actuation by means of the cable tensioning device. For the purpose of changing the actuation device and/or for adjusting an optimal length of the cable, the ends of the cable may be connected to the ends of the actuation device in an easily detachable manner, for example via quick-change devices that can be plugged onto different actuation devices and can be easily removed for changing the actuation device.

The rope tensioning device preferably contains a resetting element that acts on a displaceable reversing roller of the cable guiding system, in particular in the form of a spring or a pulling element having the elasticity of rubber, which itself may be reversed as well. The resetting element, when the cable roller is deflected from a resting position, exerts on such cable roller a resetting force when the actuation device is used, such resetting force keeping the cable taut.

In an advantageous simple embodiment, the cable is guided on the displaceable reversing roller in two parallel lines, and the range of displacement of the displaceable reversing roller, or the resetting range of the cable tensioning device is substantially equal to the symmetrical range of actuation of the actuation device with pivot points moving in the same sense. While with the known system, only one compensation of the asymmetry of the movement of the pivot points—which takes place in the opposite sense per se—is made possible by the cable tensioning device, provision is made according to an advantageous embodiment of the invention that the reset range of the cable tensioning device also permits using the actuation device when the cable pivot points of the actuation device are moving in the same sense. The reset range of the cable tensioning device is advantageously selected for said purpose in such a way that it is at least equal to or greater than the typical maximum displacement range with movement in the same sense. In particular, provision can be made that the reset range of a displacement of the pivot points in the same sense comes to at least 0.75 m, preferably at least to 1.50 m.

The displacement range of a reversing roller in the cable guiding system may be reduced vis-à-vis the desired actuation range of the actuation device in the same sense by making provision for a block-and-tackle-type of cable guidance system. A compact construction of the module comprising the mechanics can be taken into account in this way under certain circumstances.

The cable tensioning device is arranged in the section of the cable guiding system facing away from the actuation device, so that along the course of the cable, the drive system is arranged facing the actuation device in both cable lines leading from the cable tensioning device to the actuation device.

Furthermore, the cable tensioning device also may contain an elastic pulling element interconnected in the course of the cable system. The rope tensioning device including the reversing roller is advantageously displaceable in a channel that is covered at least on three sides. According to a preferred embodiment, said channel may be formed by a statically supporting component of the apparatus.

The cable guiding system comprises a cable feed-in guide in the course of the cable from the pivot points of the actuation device upstream of the drive system preferably in both cable lines, which constantly assures safe guidance of the cable especially in conjunction with an actuation device that can be freely handled, and in particular permits the cable to be fed to a driving device directly.

The cable feed-in guides may be formed, for example by sleeves having a cross section expanding toward the side of the actuation device. For another favorable embodiment of the feed-in guides, provision is made that such guides are produced from a strong wire, or from a round steel element in the form of a coil tapering in the form of a cone, whereby an extension of the round steel element at the same time serves as a fastening point for securing the feed-in guide so formed.

For the purpose of adaptation to different kinds of movements and/or different movement modules and/or different users, the position of the cable feed-in guides is advantageously variable, so that the cable runs into the cable-guiding system in as straight a line as possible and in particular with as little reversing as possible up to the drive system at least for the pulling strand of the cable. In particular the lateral position of the feed-in guides may be variable, whereas a variation in the vertical level of the initial run of the cable depending on the type of movement involved can be taken into account by the associated module of use. A starting course of the cable that extends parallel with the center plane of the apparatus is perceived by the user as being close to reality and pleasant.

In addition to imitating the pattern of movements of the paddle alternating between two sides, which is the typical pattern of motion during canoe paddling, the exercise apparatus can be advantageously used also as a training device for other patterns of movement.

According to a first proposal, provision is made for an exercise apparatus with a cable system and a cable guiding system comprising an actuation device connected to the cable system; a cable tensioning device facing away from the actuation device in the course of the cable; a brake device; and a drive system for the unilateral transmission of a pulling movement exerted by the actuation device on the cable system to a brake device, of the type as it is known from DE 296 20 700, to be used not only as a canoe ergometer, but to be employed as an exercise apparatus or ergometer also for movement patterns other than the paddling movements on two sides, which are typical of paddling a canoe. Where mention is made in the following, for example of an arm movement, the movement of the entire body connected therewith and the load are understood to be included therein.

A first group of exercise apparatuses is directed in this conjunction at a movement in opposite senses of two cable pivot points on the actuation device, as it is the case with the known canoe ergometer as well. It is particularly advantageous if the exercise apparatus is designed for imitating the movement patterns, especially the arm movement pattern employed during swimming, and in that area especially during crawl-type swimming, as well as during long-distance skiing involving alternating swinging movements of the arms, whereby provision can be made for using such apparatuses both for diagnostic and therapeutic and exercise purposes as well. Vis-à-vis the known long-distance running exercise apparatus mentioned above, a long-distance running exercise device of the type as defined by the invention shows on account of the cable tensioning device a substantially enhanced stress behavior that is perceived as being substantially more natural especially when a wind wheel is employed as the brake device.

Furthermore, an advantageous property of the exercise apparatus as defined by the invention is the fact that the present invention can be employed also for movement patterns involving movement of two load engagement points in the same sense. Especially advantageous is the embodiment of the exercise apparatus for imitating the movement during rowing, during long-distance skiing with double swinging of the arms, or with a type of swimming style where the arms or moved in the same sense such as during butterfly-style swimming, or also its embodiment as a wheelchair-type exercise apparatus.

Finally, according to another advantageous embodiment of the exercise apparatus, provision is made for only unilateral stress, in particular in the form of a kayak-type exercise apparatus.

For the purpose of imitating movement on two sides in the same sense, or movement only on one side, it is possible to substantially employ the same mechanical structure used for imitating movement on both sides in oppositely directly senses, whereby the cable-tensioning device has advantageously a clearly greater reset range versus the compensation of asymmetry in connection with the oppositely directed movement for imitating the movement in the same sense, in particular a reset range of at least 0.75 m, preferably of at least 1.50 m cable length for each strand of cable that can be actuated with the actuation device.

With respect to the various forms of embodiment of the exercise apparatus specified above, it is especially advantageous if the exercise apparatus is structured with an application-independent module containing the mechanics, and a movement module directed at a defined type of movement, or a group of types of movement. On the one hand, this offers economical benefits in the manufacture of the exercise apparatuses because the same mechanics module is employed for different types of apparatus, and the apparatuses therefore can be produced in greater numbers of units and thus at more favorable cost. This offers the user the advantageous possibility to supplement a mechanics module as the base module by a plurality of movement modules that are specific to certain types of sports disciplines, and thus to have a number of apparatuses available at favorable cost and with comparatively low space requirements. Details of advantageous constructions of various embodiments are specified in the following.

For the purpose of dividing the exercise apparatus in a mechanics module not depending on the type of movement, and a movement module depending on the type of movement, it is particularly advantageous if the cable guiding system, the brake device, the drive system and the cable tensioning device are completely accommodated in the module for accommodating the mechanics. Any adaptation to a defined type of movement to be imitated can then be achieved in a favorable manner with minor expenditure by connecting the specific movement module with the standard mechanics module, and by connecting the latter with the associated actuation device, with adaptation of the length of the cable system, if need be.

For adapting a standard mechanics module to different types of utilization of the apparatus, it is possible to advantageously make provision for a possibility for adjusting the components integrated in the module containing the mechanics, in particular for adjusting the cable guiding system. For example, the lateral spacing of cable feed-in guides, which are arranged between the drive system and the actuation device, may be variable versus the center.

It is advantageous if the apparatus can be refitted for different types of utilization by designing the mechanics module as a unit that can be set up in the operating position standing by itself. The different types of movement-specific movement modules then can be designed also as attachments to the mechanics module not standing by themselves, and in this way can be constructed under certain circumstances in a space-saving manner and with a lighter weight, and will take up less space when stored separately. Dividing the apparatus in a mechanics module of the type specified above, and a movement module is advantageous also in view of the way in which the apparatus can be easily handled due to its lower weight and in view of the favorable storage possibilities due to smaller dimensions of the separated modules. The mechanics module is preferably designed symmetrically with respect to a center plane.

The invention is explained in detail in the following with the help of preferred exemplified embodiments and by reference to the drawings, in which.

Figure 1:
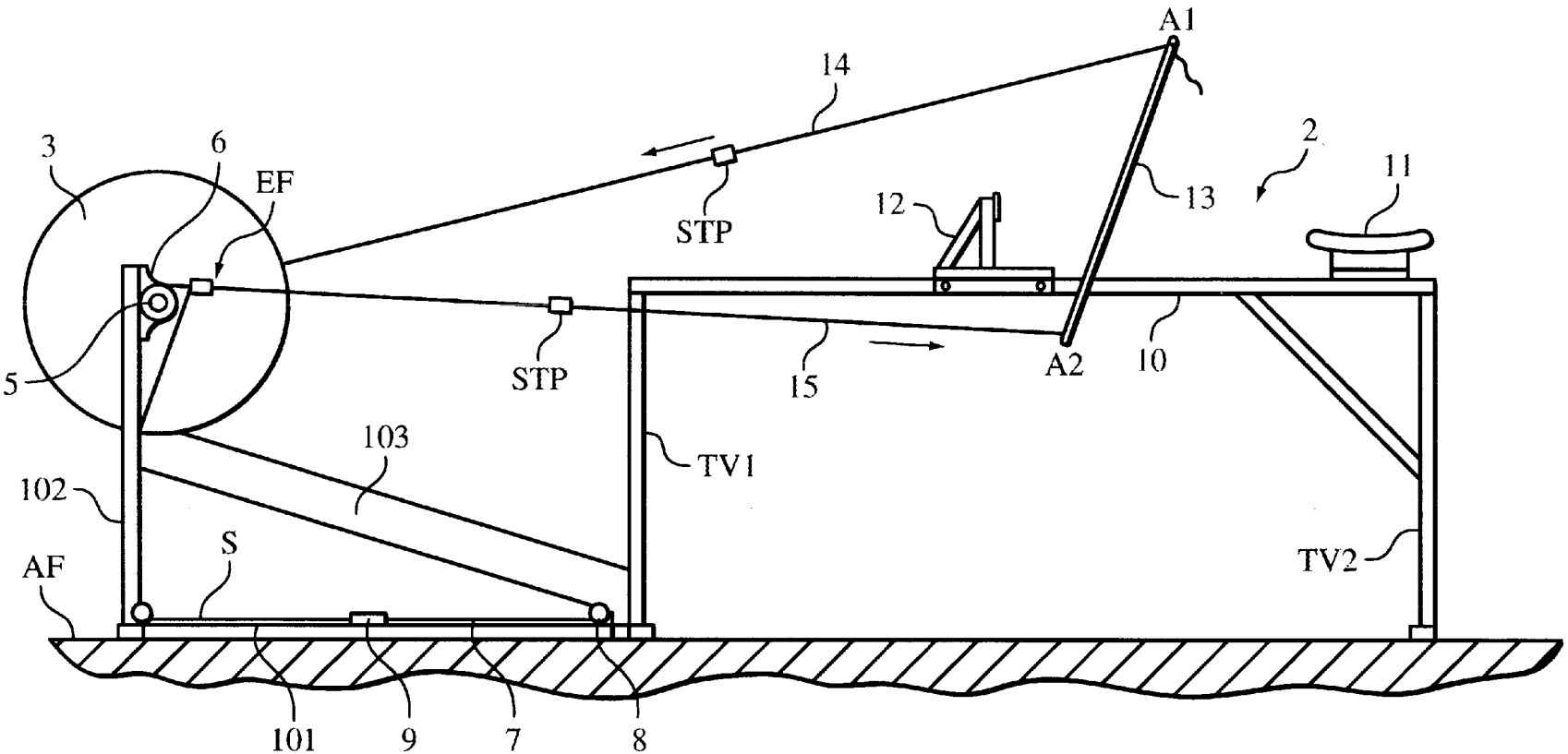
FIG. 1 is an overall view of a first canoe exercise apparatus.
Figure 2:
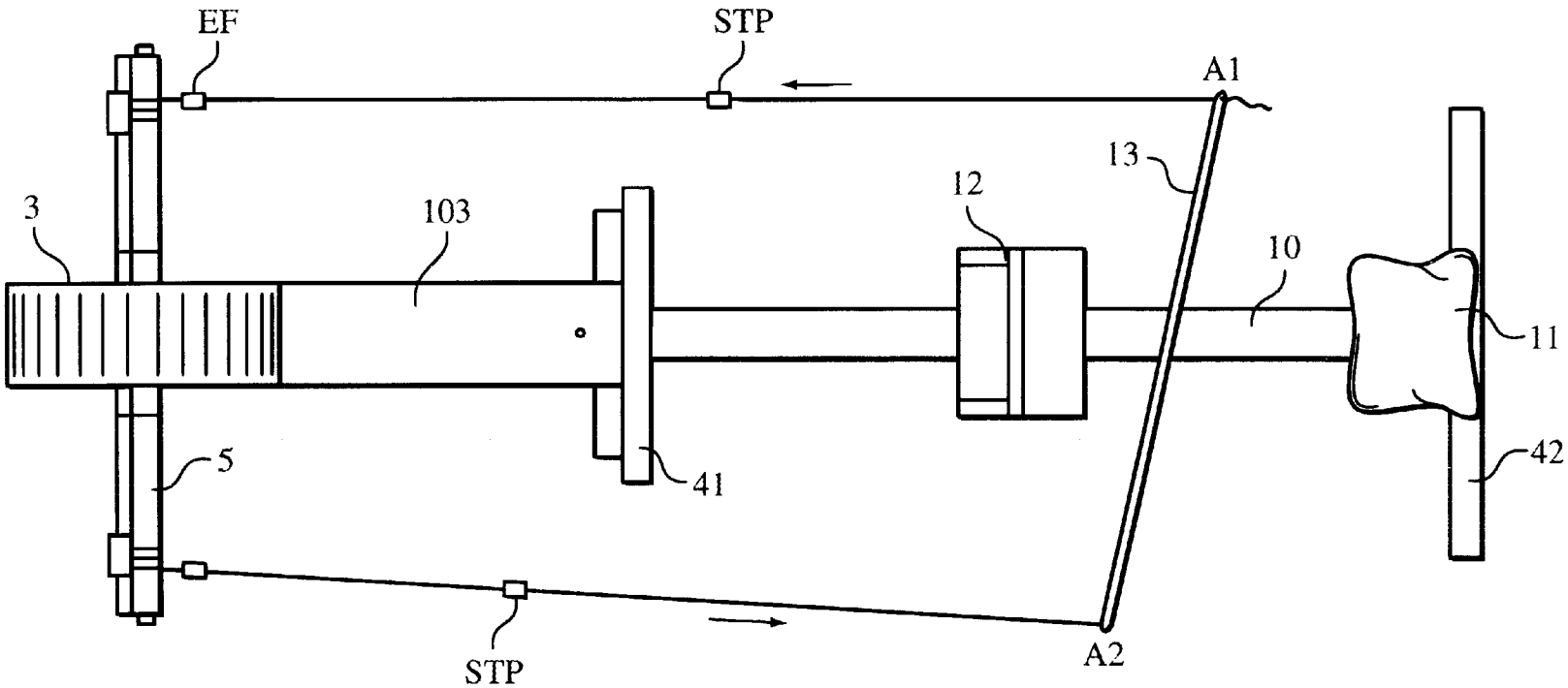
FIG. 2 is a top view of the apparatus according to FIG. 1.

In conjunction with the exercise apparatus shown sketched in FIG. 1 by a side view, a mechanics module 1, which can be set up freely standing by its own, is connected to a movement module 2, for example by way of a connection plate. In the present exemplified embodiment, the movement module 2 together with the actuation device 13 is designed for imitating the stress during paddling of a canoe, and is to that extent similar to the known canoe ergometer. The movement module 2 in particular comprises a longitudinal spar 10, on which a seat 11 and a foot support 12 are secured for the user. The spar 10 is supported at its ends by the vertical carriers TV1 and TV2. Especially for lateral stabilization, the vertical carriers may have the supports 41 and 42, which are widened vertically towards the plane of the drawing. The actuation device 13 is designed in the form of a bar for imitating a canoe paddle. Said bar may be curvatures, if need be, whereby a pivot point A1 and A2, respectively, is present on each of their opposite, spaced ends for securing a cable "S", whereby at least one of the pivot points preferably can be adjusted for adjusting the length of the cable as required for the apparatus to be effective.

The mechanics module comprises, for example a frame with the horizontal strut 101, the vertical strut 102, and the slanted strut 103 in a stable triangular construction. A wind wheel 3 with adjustable braking effect, a cable guiding system, a drive system and a cable tensioning device are accommodated in the mechanics module.

The cable guiding system, of which various embodiments are still described in the following, is designed, for example symmetrically in relation to the center plane of the exercise apparatus and especially comprises the cable feed-in guides EF, whose height above the set-up surface AF is approximately equal to the typical average height of the cable pivot point A2 in the case of the present exemplified example, said cable pivot point being coordinated with the drive system and the brake device acting on the latter. Such coordination is typically achieved via the design of the movement module 2. In the sketched exemplified case of a canoe exercise apparatus, the working height of the pivot point A2 corresponds, for example with the depth to which the paddle is stabbed into the water in the real case.

In the sketched exemplified case, the actuation device 13 is moved by the user in such a way that the end of the bar is pulled toward the user with the use of force, and thus to the right in the sketched case. The cable line 15 connected with the pivot point A2 is tensioned in this process by the force applied, and guided through the cable feed-in opening EF to the drive system, which, for example, has the form of the roller 6 and is arranged on the shaft 5 that it has in common with the brake device, whereby good transmission of the force is assured by the pulled cable line 15 on the roller 6 through multiple looping of the roller 6 by the cable. The cable line 15 tensioned by the actuation force is not reversed, or reversed only to a minor degree due to the coordination of the average height of the pivot point A2 with the height of the cable feed-in opening EF up to the drive system, so that neither the feed-in opening EF is mechanically stressed nor is the cable subjected to strong friction along the feed-in opening. By the type of movement that is typical of the imitation of the movement of the paddle when paddling a canoe, the opposite end of the actuation device 13 and the pivot point present there in the elevated position are moved away from the user during this phase of the movement, whereby substantially only the resetting force of the reset device acts on the cable line 14 during this stage. Due to the higher position of the pivot point A2, the returning cable line 14 extends through the associated cable feed-in device with a reversal occurring in the direction of the drive system, which is not active in this process, whereby the reversal at the feed-in opening, however, is not critical because of the low force of the cable exerted on this section of the cable line. The cable stoppers STP on the cable sections 14, 15 limit the drawing-in of the cable in the unstressed state and have the effect that the cable in the cable guiding system is always under the influence of the cable tensioning device with minimum tension, so that there is no need to fear that a slack cable might slide out from the reversing element.

The cable tensioning device, which, in the sketched exemplified case, has a longitudinally expandable pulling element 7 that is secured with one end on the slanted strut and guided to the cable guiding system via a reversing roller 8, is advantageously arranged within the frame of the mechanics module, and in this connection advantageously arranged within the zone of struttings. In the sketched exemplified case, the pulling element runs in a section near the slanted strut 103, said section being the first one viewed from the fastening point, and following reversal around the reversing roller 8 being located near the lower strut 101. The cable tensioning device is connected with the cable guiding system on a reversing roller 9. By displacing said roller it is possible in a manner known per se to compensate asymmetries in the displacement of the pivot points A1 and A2.

For obtaining a compact structure, the mechanics module in the plan form has the shape similar to a "T", of which the longitudinal expanse is defined by the lower strut 101 and the slanted strut 103, which advantageously each can be designed in the form of an arrangement of double struts each flanking the brake device on both sides, whereas in the transverse expanse of the T-like shape including the vertical strut 102, provision is made for a structure of struts on which the brake device, the shaft, the drive system as well as a part of the cable guiding system are secured.

Figure 3:
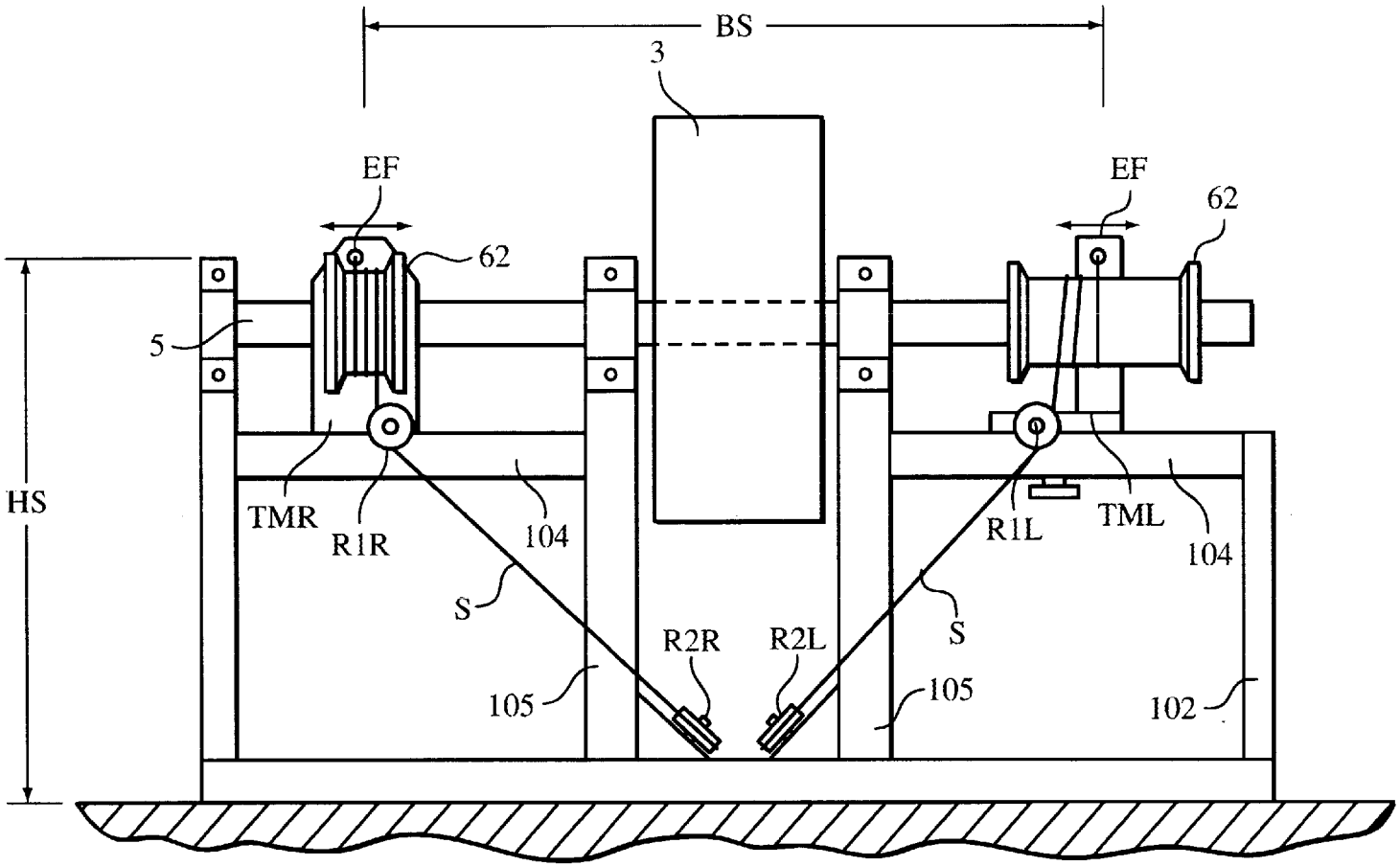
FIG. 3 is a front view of different embodiments of cable guiding systems for the apparatus according to FIG. 1.

FIG. 3 shows two advantageous embodiments of cable guidance systems and drive arrangements viewed from the front side of the mechanics module. The wind wheel 3 arranged as the brake device in the center and the rollers 6 of the drive system are jointly mounted on a common shaft 5. The shaft 5 is connected with the structure of the frame of the mechanics module on bearings not shown in the drawing in detail. If the design of the shaft 5 is adequately stable, the connection can be established on the center struts 105, which are located directly adjacent to the brake device 3, and/or on the outer struts 102 of the frame arrangement. The expert in the field is familiar with other possibilities for designing the frame and the bearings for the shaft. The roller elements 6 as the driving elements are connected with the shaft 5 via slip clutches, so that a cable line (14 in FIG. 1) running back rotates the associated shaft element substantially free of force on the shaft 5 against its working direction, whereas when the cable line (15 in FIG. 1 is pulling, the freewheel element can act in an accelerating manner on the shaft 5 and the brake device 3 connected therewith. The brake device 3 can be connected with the shaft in a fixed manner or via another freewheel element.

In the embodiment sketched in the left-hand half of FIG. 3, the drive system contains a roller 6R that is looped a number of times by the cable "S", said roller having a small construction width in the slightly axial direction. Together with a first reversing roller R1R, said roller 6R is arranged on a common carrier module TMR and displaceable with said module on the shaft. In addition, the carrier module TR also contains the cable feed-in guide EF. The carrier module can be fixed in different positions sideways, for example on a transverse strut 104 of the frame structure. It can be laterally fixed also on the freewheel element of the roller, whereby the strut 104 may then offer an additional locking possibility or only represents a safety element securing the carrier module against turning. By such joint arrangement on the carrier module it is possible to achieve simple adaptation of the lateral spacing of the feed-in openings EF and thus coordination with different movement modules and/or different actuation devices and/or different users for achieving a run of the cable that is as straight as possible at least with the cable line that is tensioned by force of actuation.

The first reversing roller R1R, which is arranged in the course of the cable upstream of the actuation device and downstream of the roller element 6R of the drive system, reverses the direction of the cable toward the center plane of the apparatus, so that the cable can run further toward the cable tensioning device near the center plane, and the guidance of the cable will not require any additional space beyond the space it needs beyond the frame arrangement in any case. For reversing the cable "S" farther toward the reversing roller 9, which is coupled with the cable tensioning device, the additional reversing rollers R2R are arranged near the center plane of the apparatus. The sketched course of the cable, which is slanted between the first reversing rollers R1R and the second reversing roller R2R, can be divided also in substantially horizontally and vertically extending sections, with interconnection of an additional reversing roller in particular if the first reversing roller has a larger adjustment range sideways.

In the embodiment sketched on the right-hand side of FIG. 3, the drive system comprises a roller 6L that is undisplaceably arranged on the shaft 5, said roller being provided with a freewheel element for coupling it to the rotation of the shaft as well. In the present case, the cable feed-in opening EF and a first reversing roller R1L are arranged on a carrier module TML and jointly displaceable in a direction extending parallel with the shaft. In the present embodiment, the roller 6L has a wider type of construction, extending across the displacement range of the carrier module TML, so that with the carrier module located in any position, the cable can be reliably guided without any canting through the feed-in opening and/or towards the reversing roller.

A great number of other possibilities for guiding the cable are conceivable, whereby the lateral displaceability of the feed-in openings EF, preferably jointly with the first reversing rollers R1R and, respectively, R1L with reversing of the rope towards the center plane of the apparatus, is especially advantageous in each case. The width BM assumed by the cable guiding system and the cable tensioning device preferably comes to less than 20 cm, in particular to less than 10 cm, and is obtained in the cable guiding system preferably already within the range of the transverse expanse of the preferred T-shape of the mechanics module. The lateral spacing BS of the feed-in openings is preferably adjustable across a range of from 45 cm to 90 cm, in particular from 60 cm to 80 cm.

Figure 4:
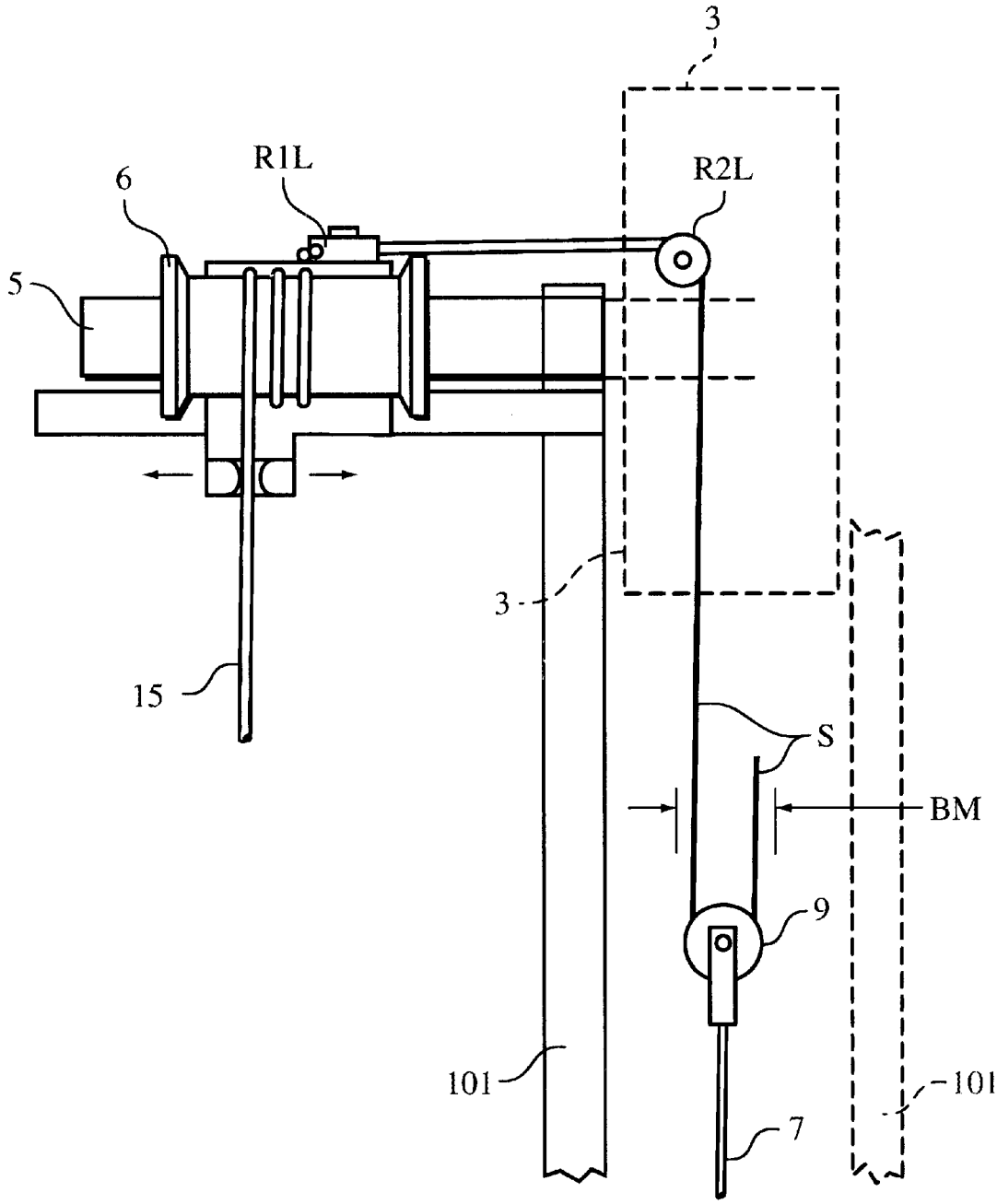
FIG. 4 is a top view of a cable guiding system.

FIG. 4 shows a top view of an arrangement of the type sketched in FIG. 3 on the right-hand side. Said view clearly shows that the cable "S" is reversed from the first reversing roller R1L to the second reversing roller R2L of the cable guiding system near the vertical plane containing the shaft 5, so that the course of the cable does not or not in any noticeable manner contribute to the expanse in the longitudinal direction of the apparatus of the arrangement of the transverse carriers (102, 104, 105) of a T-shaped design of the module containing the mechanics. The course of the cable with the reversing rollers R1L and R2L may be located also on the side of the shaft 5 facing the user, and is in that case disposed in the sketched exemplified embodiment within the triangle of the frame 101, 102, 103 shown in FIG. 1.

The width BM assumed by the further course of the cable in the direction of the reversing roller 9 and the cable tensioning device with the pulling element 7, is disposed within the width of the construction of the apparatus preset by the longitudinal struts 101 of the structure of the frame, which struts, for example are designed in the form of a double-strut system. Said width of the construction of the apparatus is in turn influenced by the width of the brake device and therefore does not by itself require any additional space. The courses of the cable between the reversing rollers R1L and R2L, as well between the reversing rollers R2L (or R2R, respectively) and the reversing roller 9, are preferably at least approximately aligned vertically or parallel with the longitudinal axis of the apparatus.

Figure 5:
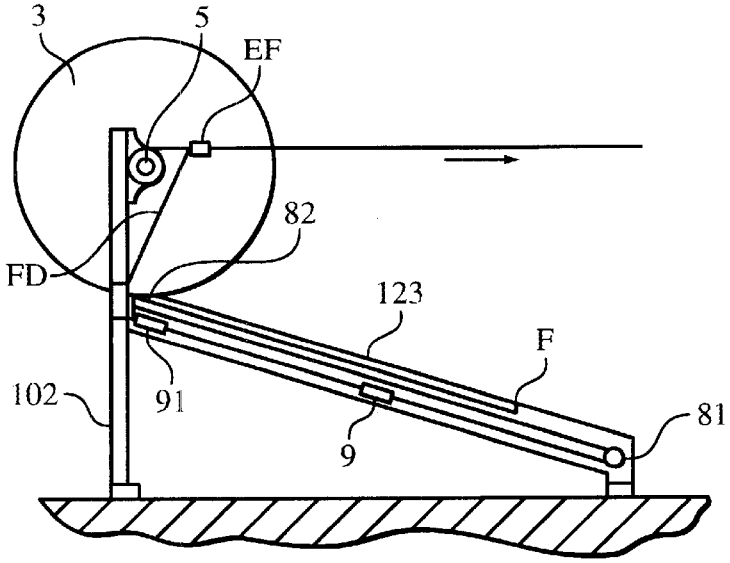
FIG. 5 is a side view of a preferred cable guiding system.
Figure 6:
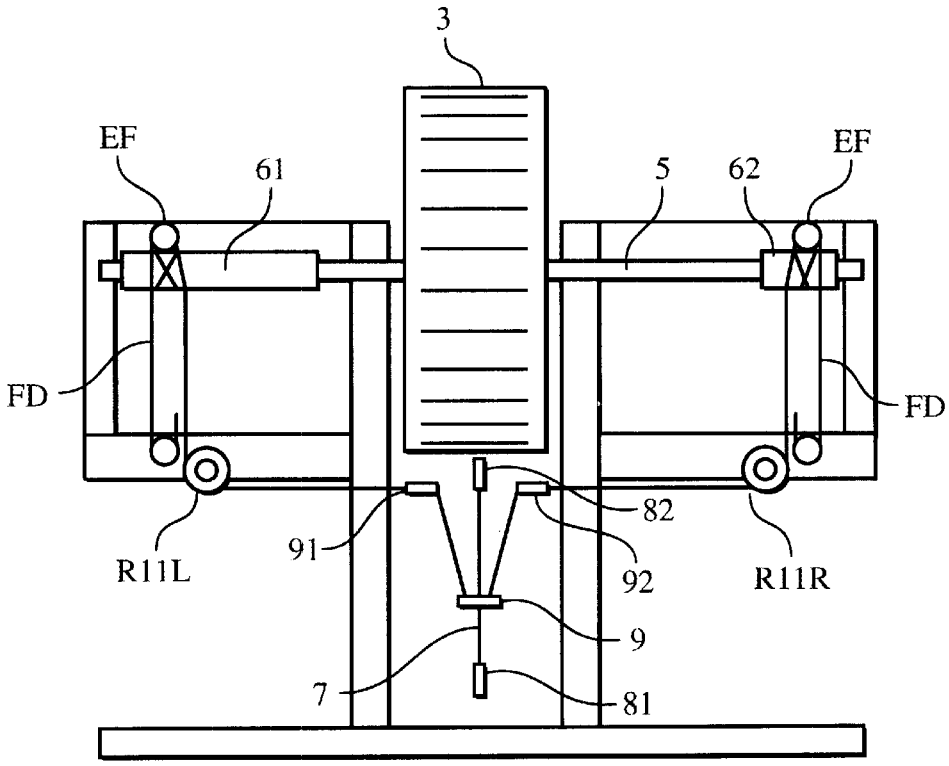
FIG. 6 is a view of the cable guidance according to FIG. 5 in the longitudinal direction.
Figure 7:
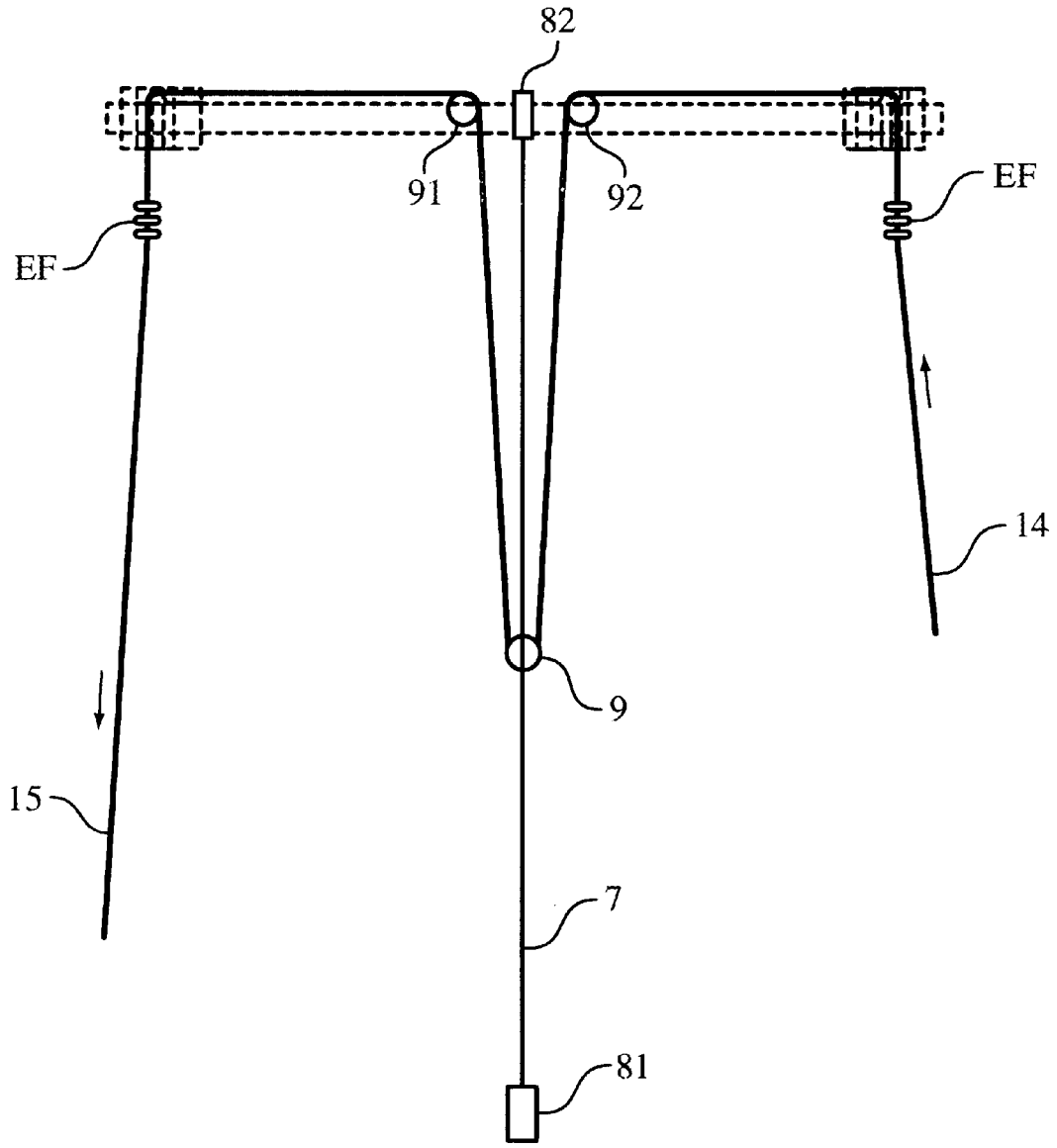
FIG. 7 is a top view of the cable guidance according to FIGS. 5 and 6.

An advantageous structure of a mechanics module is sketched in FIG. 5 by a side view, with the slanted strut 123 cut open. The mechanics module of the embodiment sketched in FIG. 5 dispenses with an additional horizontal strut near the floor and is stabilized by the connection between the slanted strut 123 and the vertical strut system 102. In the sketched exemplified embodiment, the system for guiding the cable in the longitudinal direction of the apparatus is substantially completely accommodated within the slanted strut 123 that is shown cut open. The cable feed-in guides EF for the cable are designed in the sketched exemplified case shown in FIGS. 5 to 7 in the form of the wire-guiding elements FD, in connection with which a strong wire or a thin round steel element is wound in the form of a conical coil within the zone of the feed-in guides and connected with the structure of the struts of the mechanic module with a spacing from the feed-in guides. The fastening so spaced from the cable feed-in guides EF permits within certain limits elastic yielding and reduces in this way the friction load acting on the cable on the feed-in guides. In the manner already described in the foregoing, the cable loops the rollers 61 (larger width) and, respectively 62 (smaller width) located on the shaft 5 a number of times in order to drive the wind wheel 3 acting as the brake device with the pulling strand of the cable. From the rollers 61 and 62, respectively, the cable is guided downwards in or near the plane of the vertical strut structure 102 and to the reversing rollers R11L and R11R, which are already vertically located below the lower edge of the wind wheel 3. With the help of the last-mentioned reversing rollers, the cable is guided substantially horizontally to the center of the arrangement, and reversed near the center plane to the displaceable reversing roller 9, such reversal preferably taking place already within the width of the slanted strut 123 via the other reversing rollers 91 and, respectively 92, in the longitudinal direction of the apparatus or the slanted strut 123. In a manner already described per se in the foregoing, the reversing roller 9 is engaged by the pulling element 7, which in particular can be a rubber cable. The pulling element 7 is guided with a number of reversals via the additional reversing rollers 81 and 82 within the slanted strut 123, which, for example may have a U-shaped cross section, and is secured in an attachment site F. The attachment site F is preferably displaceable along the slanted strut 123, so that it is possible to adjust an initial tension.

Figure 8:
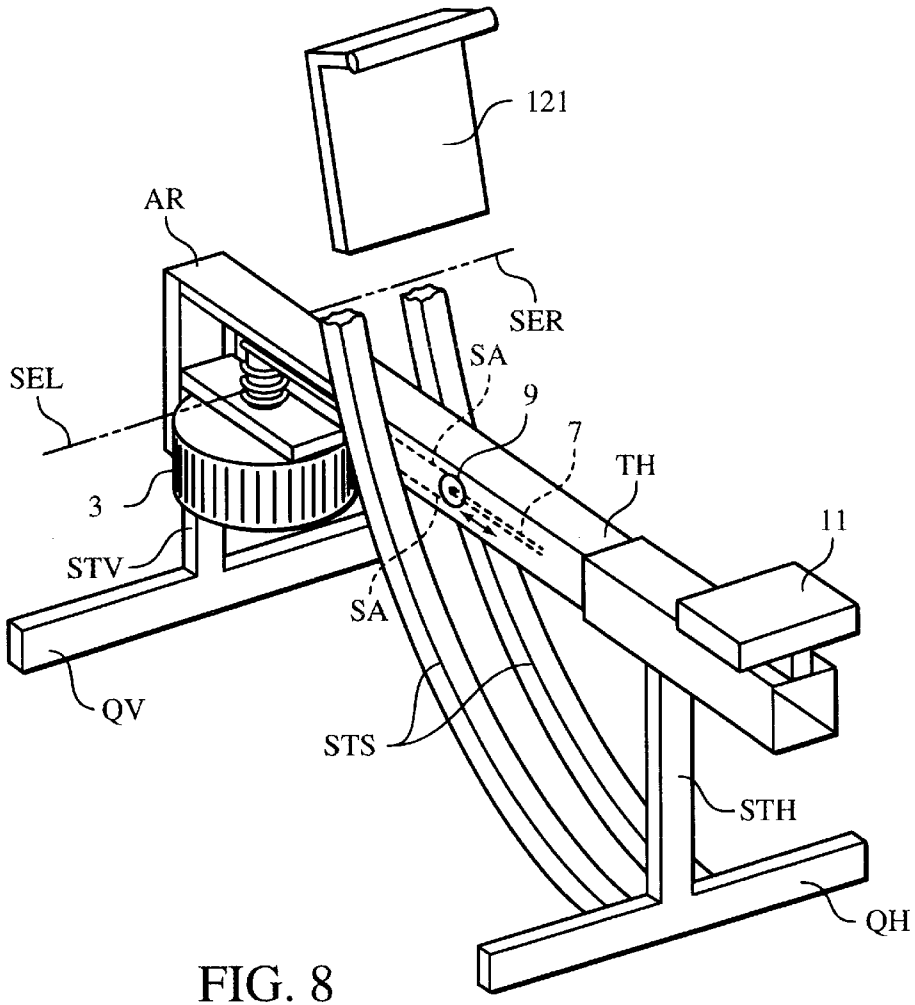
FIG. 8 is an inclined view of another exercise apparatus.
Figure 9:
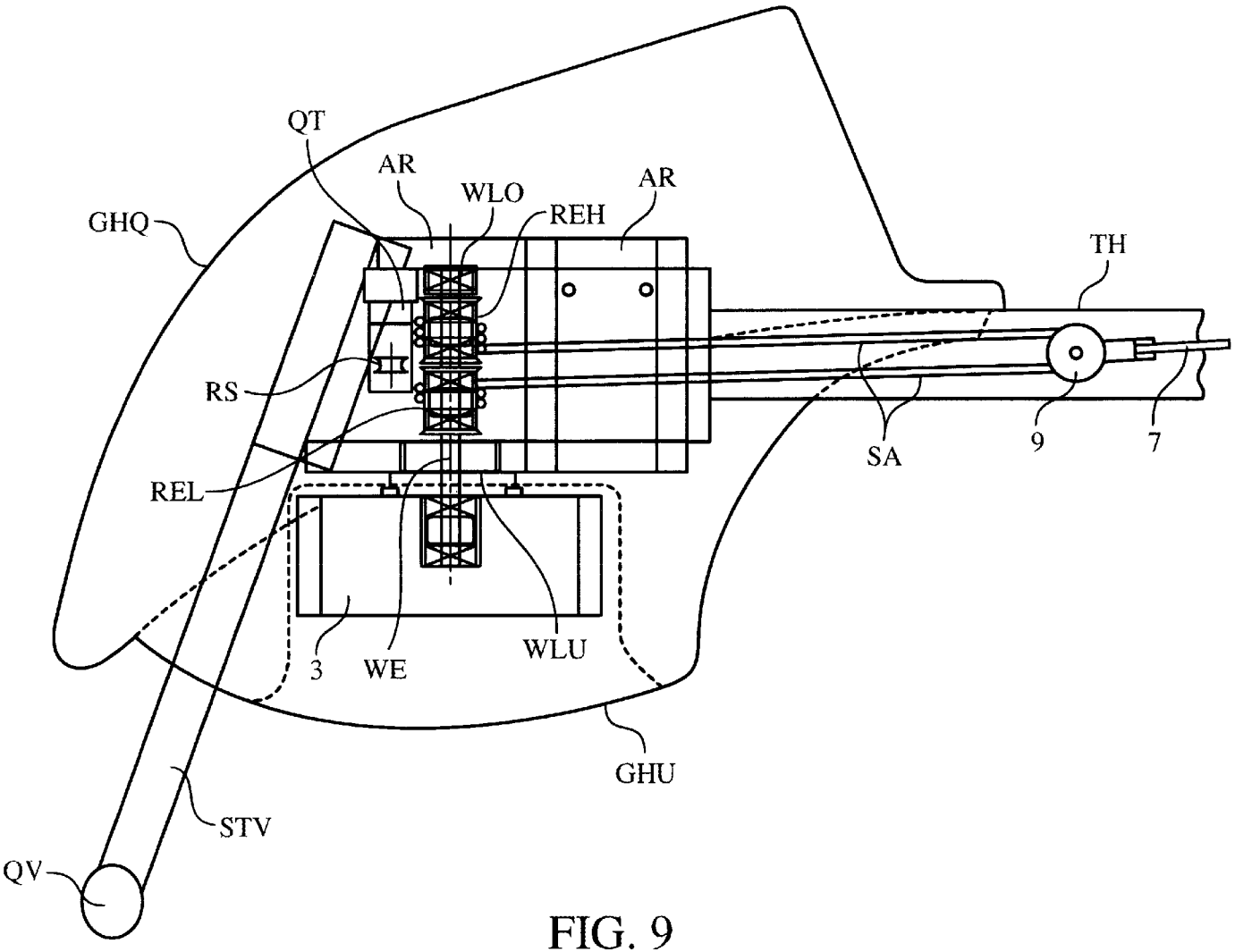
FIG. 9 is a detailed view of the drive system and the brake device of an exercise apparatus similar to the one shown in FIG. 8.

Preferred structures of the apparatus comprising a drive unit that is compacted in a particularly favorable manner, are sketched in FIGS. 8 and 9. The drive unit is particularly characterized in that a brake device 3 and two roller elements REH and REL looped by the cable system are arranged on a common upright, vertically aligned shaft. The common shaft WE is connected with torsional strength to the brake device 3, which in particular is a rotating wind wheel. The roller elements REH and REL are coupled with the shaft WE via freewheel elements revolving in the same sense. The shaft WE is supported on both sides of the roller elements REH and REL—which are arranged close to one another—in an upper shaft bearing WLO and a lower shaft bearing WLU, and projects downwards beyond the bottom shaft bearing WLU, where the brake device is secured on the shaft.

In addition to a rotating braking element, the brake device preferably contains, for example a fan wheel, and a fixed housing surrounding said fan wheel. Said housing may particularly comprise adjusting elements for varying the braking effect.

The shaft WE with the brake device 3 and the roller elements REH and REL is advantageously arranged in or at least close to the vertical center plane extending in the longitudinal direction of the apparatus. The ends of the cable system coming from the actuation device are reversed on the reversing devices RS to the roller elements, said reversing devices being arranged spaced from the center plane. The reversing devices in particular each may contain at least one reversing roller and may be displaceable as well for varying the spacing between the cable feed-in points leading on both sides into the cable system in the manner described in connection with FIG. 3. The reversing devices are advantageously secured on a crosstie rod QT connected with a drive frame AR of the drive unit.

The cable sections SEL and SER laterally approaching the roller elements REL and REH, respectively, loop the roller elements in the same sense, for example anticlockwise viewed from the top, and exit from the roller elements vertically spaced from one another and approximately parallel with the center plane rearwards, i.e. pointing at the user. The cable sections running out are disposed in this connection for both roller elements on the same side of the shaft WE, for example on the left-hand side viewed from the top. In the preferred embodiment of the cable system, the cable sections running out change into one another in the form of a through-extending cable and are disposed above a reversing roller 9 that is displaceable against the resetting force exerted by the cable tensioning device 7. In this connection, the reversing roller 9 may be standing upright preferably with a horizontal axis of rotation while maintaining the parallel, vertically spaced cable sections SA, or following reversal of the vertically spaced cable sections SA disposed with vertical alignment of the axes. The reversing roller may be guided when displaced along a rod, a rocker arm etc. with low friction. The cable sections SA with the reversing roller 9 are advantageously protected in a covered channel. The shaft may be slightly offset sideways vis-à-vis the center plane in such a way that the cable sections running off from the roller elements are disposed in said center plane from the start on.

The training apparatus according to FIG. 8 contains a front vertical support STV and a rear vertical support STH, which are connected via a bridge. The bridge particularly comprises a longitudinal strut TH and a drive frame AR, which contains the complete drive unit comprising the roller elements, the shaft and the brake device. The drive frame preferably still comprises also a transversely extending crosstie rod that supports the laterally spaced reversing devices and the cable feed-in guides. The cable sections SA, the reversing roller 9 and the cable tensioning device 7 are advantageously accommodated in the hollow longitudinal strut, which is designed in the form of a U-section as well. The various modules are advantageously designed in such a way that they can be plugged into one another. The connection between the rear vertical support and the horizontal longitudinal strut TH can be advantageously stiffened by the struts STS extending in an inclined manner, said struts extending curved in the sketched exemplified embodiment. A foot board 121 for supporting the feet can be secured on slanted struts. The vertical supports STV and STH are designed in a stable manner with the help of the cross struts QV and QH, respectively. The elementary structure comprising the detachably connected components STV, STH, TH and AR permits to achieve a particularly small volume during shipping and storage. The drive unit contains the most important mechanical elements and can be manufactured and tested separately. The variability for imitating different kinds of motion with the help of different movement modules remains preserved by the structure comprising detachably connected elements.

In the structure sketched in FIG. 9, the drive unit is covered by a housing comprising an upper cup GHO and a lower cup GHU. The wind wheel, which may be provided with a casing, if need be, can be arranged outside of the housing cup GHU, in which case the latter then preferably has an inward bulging serving as the space for receiving the brake device.

The roller elements may be arranged also on separate, spaced axles located near the center plane of the apparatus, whereby the spacing of the axles from each other is small versus the lateral spacing BS of the cable inlets. Coupling to the brake device then takes place via additional transmission elements. In conjunction with roller elements aligned in a coaxial manner, the brake device also may rotate on a separate shaft, whereby a gear for reducing the rate of revolutions between the roller elements and the brake device is still possible as well. However, the coaxial arrangement of the roller elements and the brake device sketched in FIGS. 8 and 9 is particularly advantageous by virtue of its simple structure.

The features specified in the foregoing and in the claims can be realized in an advantageous manner both individually and in different combinations. The invention is not limited to the exemplified embodiments described herein, but rather can be modified in many ways within the framework of the skills of the expert. The expert is familiar with alternative solutions especially with respect to the details of the structure of the frame, the cable guiding system etc., with inclusion of additional reversing rollers, the bearing of the shaft, the drive systems, and the common carrier modules.

What is claimed is:

1. An exercise apparatus comprising:

(a) a cable system;

(b) a cable guiding system comprising an actuation device coupled with and exerting a pulling motion on said cable system;

(c) a cable tensioning device facing away from said actuation device in the course of the cable system;

(d) a rotatably driven brake device coupled to said cable system;

(e) a drive system coupled to said cable system for unidirectionally transmitting the pulling motion exerted by said actuation device on said cable system to said brake device, said drive system comprising two roller elements arranged near a center plane of the apparatus with a slight spacing from each other.

2. The apparatus according to claim 1, wherein the roller elements are arranged coaxially one on top of the other.

3. The apparatus according to claim 2, wherein the brake device is arranged coaxially with the roller elements.

4. The device according to claim 3, wherein a common shaft is connected in a fixed manner with a rotor of the brake device and coupled with the roller elements via freewheel elements rotating in the same sense.

5. The apparatus according to claim 1, wherein the cable system contains a through-extending cable and the cable tensioning device comprises a reversing roller for a reversing loop of the cable system, said reversing roller being displaceable parallel with the center plane against a resetting force.

6. The apparatus according to claim 5, wherein the possible range of displacement of the reversing roller amounts to at least 0.75 m.

7. The apparatus according to claim 5, wherein the cable system and/or the cable tensioning device are at least partly guided in a covered channel.

8. The apparatus according to claim 7, wherein the channel extends around the center plane in the longitudinal direction of the apparatus.

9. The apparatus according to claim 8, wherein the channel is formed by a statically supporting component of the apparatus.

10. The apparatus according to claim 1, wherein a mechanics module is connected in a detachable manner to a movement module specific to kinds of movement.

11. The apparatus according to claim 1, wherein the cable guiding system comprises a block-and-tackle system.

12. The apparatus according to claim 1, wherein the cable guiding system comprises two laterally spaced cable feed-in guides.

13. The apparatus according to claim 12, wherein the position of the cable feed-in guides is variable.

14. The apparatus according to claim 12, further comprising cable stoppers in the cable system located between the actuation device and the cable feed-in guides.

15. The apparatus according to claim 16, further comprising systems for measuring and/or displaying the force and/or the performance when the apparatus is actuated.

16. An exercise apparatus comprising:

(a) a cable system;

(b) a cable guiding system comprising an actuation device coupled with and exerting a pulling motion on said cable system;

(c) a cable tensioning device facing away from said actuation device in the course of the cable system;

(d) a rotatably driven brake device coupled to said cable system;

(e) a drive system coupled to said cable system for unidirectionally transmitting the pulling motion exerted by said in actuation device on said cable system to said brake device, said drive system comprising two coaxially aligned, spaced-apart roller elements, said brake device is arranged between and coaxially aligned with said roller elements, said cable tensioning device comprising a reversing roller for a reversing loop of the cable system, and said cable system containing a cable extending between said roller elements via said reversing roller.

17. The apparatus according to claim 16, wherein the cable guiding system reverses the cable system from the roller elements transversely in relation to the longitudinal axis of the apparatus to the center plane of the apparatus and reversed there again parallel with the center plane.

* * * * *